United States Patent [19]

Iwakura et al.

[11] Patent Number: 4,981,835

[45] Date of Patent: Jan. 1, 1991

[54] RECORDING MATERIAL

[75] Inventors: Ken Iwakura; Naoto Yanagihara; Takayuki Hayashi, all of Shizuoka, Japan

[73] Assignee: Fuji Photo Film Co., Ltd., Kanagawa, Japan

[21] Appl. No.: 385,508

[22] Filed: Jul. 27, 1989

[30] Foreign Application Priority Data

Jul. 27, 1988 [JP] Japan ..... 63-187806
Jan. 11, 1989 [JP] Japan ..... 64-4447
Feb. 16, 1989 [JP] Japan ..... 64-37070

[51] Int. Cl.[5] ..... B41M 5/18

[52] U.S. Cl. ..... 503/209; 503/208; 503/225

[58] Field of Search ..... 427/150–152; 503/208, 209, 225

[56] References Cited

U.S. PATENT DOCUMENTS 4,538,164 8/1985 Takigawa et al. ..... 503/209
4,539,577 9/1985 Kaneko et al. ..... 503/207
4,644,375 2/1987 Satake et al. ..... 503/209

FOREIGN PATENT DOCUMENTS 0155096 9/1984 Japan ..... 503/209
0031287 2/1986 Japan ..... 503/209

*Primary Examiner*—Bruce H. Hess
*Attorney, Agent, or Firm*—Sughrue, Mion, Zinn, Macpeak & Seas

[57] ABSTRACT

A recording material comprising an electron donating colorless dye and an electron accepting compound is disclosed, the recording material further comprising, as a heat-fusible substance, a benzyl ether derivative represented by formula (I):

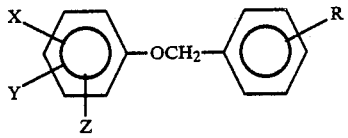

(I)

wherein R represents a halogen atom or a substituted or unsubstituted alkoxy group; and when R is a substituted or unsubstituted alkoxy group, X, Y and Z, which may be same or different, each represents a hydrogen atom, a substituted or unsubstituted alkyl group, a substituted or unsubstituted alkoxy group or a halogen atom; and when R is a halogen atom, X represents a substituted or unsubstituted alkoxy group, and Y and Z each represents a hydrogen atom.

The recording material exhibits improved color developability and color forming sensitivity.

14 Claims, No Drawings

RECORDING MATERIAL

FIELD OF THE INVENTION

This invention relates to a recording material utilizing color formation reaction between an electron donating colorless dye and an electron accepting compound, and more particularly to a recording material which exhibits improved color developability and color forming sensitivity.

BACKGROUND OF THE INVENTION

Recording materials using a combination of an electron donating colorless dye (hereinafter referred to as color former) and an electron accepting compound (hereinafter referred to as color developer) are well known as pressure-sensitive paper, heat-sensitive paper, light- and pressure-sensitive paper, electric heat-sensitive paper, and heat sensitive transfer paper. The details for these recording materials are described, e.g., in British Patent No. 2,140,449, U.S. Pat. Nos. 4,480,052 and 4,436,920, JP-B-60-23992 (the term "JP-B" as used herein means an "examined Japanese patent publication"), and JP-A-57-179836, JP-A-60-123556, and JP-A-60-123557 "JP-A" as used herein means an "unexamined published Japanese patent application").

Further, in order to improve color developability and color sensitivity, various kinds of ether compounds and thioether compounds have been proposed as heat-fusible substances for use in recording materials, as described, e.g., in U.S. Pat. Nos. 4,471,074 and 4,480,052. Any of these known heat-fusible substances, however, have some disadvantages in terms of developed color density, sensitivity, and the like.

Extensive studies on these recording materials have been carried out with the purpose of improving their characteristics such as (1) color density and color forming sensitivity and (2) fastness of a developed color image.

The inventors have investigated numerous color formers, color developers and other components of the recording material paying attention to their solubility in oil or water, partition coefficient, pKa, polarity of substituents, position of substituents, change in crystallizability and solubility when used in combination, and the like.

SUMMARY OF THE INVENTION

One object of this invention is to provide a recording material having satisfactory color developability, particularly in terms of color developability and fastness of developed color image while satisfying other requirements.

It has now been found that the above object of this invention can be accomplished by using, as a heat-fusible substance, a benzyl ether derivative represented by formula (I) shown below.

The present invention relates to a recording material containing a color former, a color developer and, as a heat-fusible substance, a benzyl ether derivative represented by formula (I):

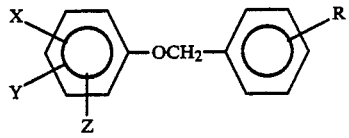

(I)

wherein R represents a halogen atom or a substituted or unsubstituted alkoxy group; and when R is a substituted or unsubstituted alkoxy group, X, Y and Z, which may be same or different, each represents a hydrogen atom, a substituted or unsubstituted alkyl group, a substituted or unsubstituted alkoxy group or a halogen atom; and when R is a halogen atom, X represents a substituted or unsubstituted alkoxy group, and Y and Z each represents a hydrogen atom.

DETAILED DESCRIPTION OF THE INVENTION

In formula (I), the alkoxy group as represented by R, X, Y, or Z may have one or more substituent selected from an alkoxy group, an aryloxy group, a halogen atom, a cyano group, etc. The alkoxy group inclusive of substituents preferably contains from 1 to 18 carbon atoms, more preferably from 1 to 4 carbon atoms.

Specific examples of the alkoxy group are methoxy, ethoxy, propoxy, isopropoxy, butoxy, methoxymethoxy, methoxyethoxy, and chloroethoxy groups.

The alkyl group as represented by X, Y or Z may have a substituent selected from a halogen atom, an aryl group, an alkoxy group, etc. The alkyl group preferably contains from 1 to 6 carbon atoms, more preferably from 1 to 2 carbon atoms.

Specific example of the alkyl group are a methyl group, an ethyl group, a propyl group, an isopropyl group and a butyl group. Among them, a methyl group and an ethyl group are preferred.

Example of the halogen atoms which can be used as R, X, Y or Z of the present invention include a fluorine atom, a chlorine atom, a bromine atom and an iodine atom. Among them, the chlorine atom is preferred.

The benzylaryl ether derivative represented by formula (I) is preferably having at least one alkoxy group having from 1 to 4 carbon atoms, and at least one of the alkoxy groups is preferably at the para-position with respect to the phenoxymethyl group, or at the paraposition with respect to the benzyloxy group. Among them, compounds having a methoxy group or an ethoxy group, and a halogen atom as substituents thereof are more preferred.

Among these compounds, the compounds represented by the following formulae (II) to (IV) are still more preferred.

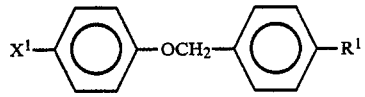

(II)

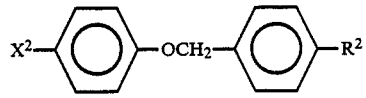

(III)

-continued

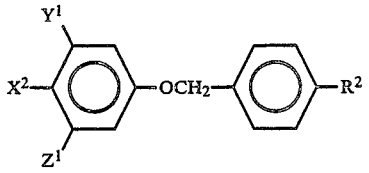

(IV)

wherein the above formulae, $X^1$ represents an alkoxy group, $X^2$ represents an alkyl group or an alkoxy group, $X^3$ represents a halogen atom, $Y^1$ and $Z^1$ each represents a hydrogen atom or an alkyl group, $R^1$ represents a halogen atom, and $R^2$ represents an alkoxy group.

Specific but non-limiting examples of the compounds represented by formulae (I) to (IV) are 4-methoxyphenyl-4'-chlorobenzyl ether, 4-chlorophenyl-4'-methoxybenzy ether, 4-ethoxyphenyl-4'-chlorobenzyl ether, 4-chlorophenyl-4'-ethoxybenzyl ether, 4-chlorophenyl-4'-propoxybenzyl ether, 2-methoxyphenyl-4'-chlorobenzyl ether, 4-chlorophenyl-4'-butoxybenzyl ether, 4-methylphenyl-4'-methoxybenzyl ether, 4-ethylphenyl-4'-methoxybenzyl ether, 4-methylphenyl-4'-ethoxybenzyl ether, 4-ethylphenyl-4'-ethoxybenzyl ether, 4-fluorophenyl-4'-methoxybenzyl ether, 4-fluorophenyl-4'ethoxybenzyl ether, 4-propoxyphenyl-4'-chlorobenzyl ether, 2,3-dichlorophenyl-4'-methoxybenzyl ether, 2,5-dichlorophenyl-4'-methoxybenzyl ether, 2,3-dimethylphenyl-4'-methoxybenzyl ether, 3,4-dimethylphenyl-4'-methoxybenzyl ether, 4-chloro-3-methylphenyl-4'-methoxybenzyl ether, 2-chloro-5-methylphenyl-4'-methoxybenzyl ether, 4-chloro-3-methylphenyl-4'-ethoxybenzyl ether and 3,5-dimethyl-4-chlorophenyl-4'-methoxybenzyl ether.

Among them, 4-ethylphenyl-4'-methoxybenzyl ether, 4-methylphenyl-4'-methoxybenzyl ether, 4-methylphenyl-4'-ethoxybenzyl ether, 4-chlorophenyl-4'-methoxybenzyl ether, 4-chlorophenyl-4'-ethoxybenzyl ether, 4-methoxyphenyl-4'-chlorobenzyl ether, 4-ethoxyphenyl-4'-chlorobenzyl ether, 4-chloro-3-methylphenyl-4'-methoxybenzyl ether, 4-chloro-3-methylphenyl-4'-ethoxybenzyl ether, 3,5-dimethyl-4-chlorophenyl-4'-methoxybenzyl ether, 4-fluorophenyl-4'-methoxybenzyl ether and 4-fluorophenyl-4'-ethoxybenzyl ether are preferred.

A melting point of the benzyl ether derivative of the present invention which can be used as the heat-fusible substance is preferably from 50° to 120° C.

The alkoxy substituted or the halogen substituted benzyl ether derivative of the present invention can be synthesized by the synthetic method for the conventional benzyl ether derivative as described, for example, in *ORGANIC SYNTHESIS*, vol. 1, page 435. Namely, they can be synthesized by reacting the corresponding benzyl halide with the corresponding phenol derivative in the presence of a basic catalyst. The reaction may be carried out with or without a solvent such as a polar solvent (e.g., dimethylformamide, dimethylacetamide, ethanol, MEK, acetoanilide, sulfolan, THF).

The color former which can be used in the present invention includes triphenylmethane phthalide compounds, fluoran compounds, phenothiazine compounds, indolyl phthalide compounds, leuco-auramine compounds, rhodamine lactam compounds, triphenylmethane compounds, triazene compounds, spiropyran compounds, and fluorenone compounds.

Specific examples of these color formers and their associated developers are described in U.S. Reissue Pat. No. 23,024, U.S. Pat. Nos. 3,491,111, 3,491,112, 3,491,116, and 3,509,174 for the phthalide compounds; U.S. Pat. Nos. 3,624,107, 3,627,787, 3,641,011, 3,462,828, 3,681,390, 3,920,510, and 3,959,571 for the fluoran compounds; U.S. Pat. No. 3,971,808 for the spirodipyrane compounds; U.S. Pat. Nos. 3,775,424, 3,853,869, and 4,246,318 for the pyridine and pyrazine compounds; and JP-A-63-94878 for the fluorene compounds.

Preferred among them are fluoran compounds. Specific examples of the fluoran compounds are 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylamino-fluoran, 2-anilino-3-chloro-6-diethylaminofluoran, 2-anilino-3-methyl-6-diisobutylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, and 2-anilino-3-chloro-6-N-ethyl-N-isoamylaminofluoran.

The color developer which can be used in the present invention includes phenolic derivatives, metal salts of aromatic carboxylic acids, acid clay, bentonite, novolak resins, metallized novolak resins, and metal complexes. Specific examples of these color developers are described in JP-B-40-9309 and JP-B-45-14039, JP-A-52-140483, JP-A-48-51510, JP-A-57-210886, JP-A-58-87089, JP-A-59-b 11286, JP-A-60-176795, and JP-A-61-95988.

The color former is coated in a coated weight of preferably from 0.1 to 1.0 g/m$^2$ in the present invention.

The color developer is preferably used in an amount of from 50 to 5,000% by weight, more preferably from 100 to 2,000% by weight, based on the electron donating colorless dye.

The benzyl ether derivative according to the present invention is preferably used in an amount of from 10 to 500% by weight, more preferably from 50 to 200% by weight, based on the electron accepting compound.

In the production of the recording material of the present invention, each of the abovedescribed color former, color developer, and the benzyl ether derivative is used in the form of a fine dispersion, fine droplets, or a film.

The heat-sensitive recording material to which the present invention is applied embraces various embodiments as described, e.g., in JP-A-62-144989 and JP-A-1-87291. In general, each of the color former, the color developer, and the benzyl ether derivative is dispersed in a dispersing medium to a particle size of not greater than 10 μm, preferably of not greater than 3 μm. The dispersing medium usually includes a binder such as an aqueous solution of a water-soluble high polymer, for example, polyvinyl alcohol, in a concentration of from about 0.5 to 10% by weight. The dispersing can be carried out by means of a ball mill, a sand mill, a horizontal sand mill, and attritor, a colloid mill, etc.

If desired, the coating composition for the recording layer further contains various additives for meeting various requirements. For example, in order to prevent contamination of the recording head, a pigment or an oil-absorbing substance, such as a polyurea filler, may be incorporated into the binder. Further, in order to improve release of the recording material from the recording head, a fatty acid, a metallic soap, etc. is added to the coating composition. Thus, the coating composition usually comprises, in addition to the color former and color developer which directly take part in color formation, an other heat-fusible substance other than the compounds represented by formulae (I) to (IV) such as amide compounds and urea compounds (e.g., stearamide, palmitamide, N-phenylstearamide, and N-stearylurea), a pigment, a wax, an antistatic agent, an ultraviolet absorbent, a defoaming agent, a conductive agent, a fluorescent dye, a surface active agent, and the like.

If desired, a protective layer can be provided on the heat-sensitive recording layer. The protective layer may be composed of a single layer or two or more layers. For the purpose of correcting curl balance of a support or improving chemical resistance of the back of the support, a backing layer having a composition similar to that of the protective layer may be provided on the back of the support In a modified embodiment, a release paper may be adhered to the back of the support via an adhesive to provide a label.

The color former and the color developer are usually coated dispersed in a binder. Generally employed binders are water-soluble and include polyvinyl alcohol, hydroxyethyl cellulose, hydroxypropyl cellulose, epichlorohydrin-modified polyamide, an ethylene-maleic anhydride copolymer, a styrene-maleic anhydride copolymer, an isobutylene-maleic anhydride-salicylic acid copolymer, polyacrylic acid, polyacrylamide, methylol-modified polyacrylamide, starch derivatives, casein, and gelatin. For the purpose of imparting water resistance to the binder, a water resistance imparting agent or an emulsion of a hydrophobic polymer (e.g., a styrene-butadiene rubber latex, an acrylic resin emulsion) may be added to the binder.

The coating composition thus prepared is coated on a support, e.g., paper, fine paper, synthetic paper, a plastic sheet, resin-coated paper, and neutral paper.

The electric heat-sensitive recording materials to which the present invention is applicable can be produced in accordance with the methods disclosed, e.g., in JP-A-49-11344 and JP-A-50-48930.

The present invention is now illustrated in greater detail by way of the following Examples, but it should be understood that the present invention should not be construed as being limited thereto. In these examples, all the percents are by weight unless otherwise indicated.

EXAMPLE 1

To a solution of 108 g of p-cresol and 138 g of potassium carbonate in 0.5 l of N,N-dimethylacetamide was added 160 g of p-methoxybenzyl chloride, and the mixture was allowed to react at 85° C. for 3 hours while stirring. The reaction mixture was poured into water, and the precipitated crystals were collected by filtration and recrystallized from methanol-ethyl acetate to obtain 229 g of 4-methylphenyl-4'-methoxybenzyl ether having a melting point of 88° C.

EXAMPLES 2 TO 14

In the same manner as in Example 1, there were obtained 4-ethylphenyl-4'-methoxybenzyl ether (m.p.=76°-77° C.), 4-methylphenyl-4'-ethoxybenzy ether (m.p.=77°-78° C.), 4-ethylphenyl-4'-ethoxybenzyl ether (m.p.=77.5-79° C.), 4-chlorophenyl-4'-methoxybenzyl ether (m.p.=104° C.), 4-chlorophenyl-4'-ethoxybenzyl ether (m.p.=86° C.), 4-methoxyphenyl-4'-chlorobenzyl ether (m.p.=83° C.), 3-methyl-4 chlorophenyl-4'-methoxybenzyl ether (m.p.=84° C.), 3-methyl-4-chlorophenyl-4'-ethoxybenzyl ether (m.p.=84° C.), 5-methyl-2-chlorophenyl-4'-methoxybenzyl ether (m.p.=75° C.), 3,5-dimethyl-4-chlorophenyl-4'-methoxybenzyl ether (m.p.=91° C.), 4-ethoxyphenyl-4'-chlorobenzyl ether (m.p.=88° C.), 4-fluorophenyl-4'-methoxybenzyl ether (m.p.=97° C.) and 4-fluorophenyl-4'-ethoxybenzyl ether (m.p.=98° C.).

EXAMPLE 15

20 g each of 2-anilino-3-methyl-6-N-ethyl-N-isoamylaminofluoran as a color former, bisphenol A as a color developer, and 4-chlorophenyl-4'-methoxybenzyl ether as a heat-fusible substance were separately dispersed in 100 g of a 5% aqueous solution of polyvinyl alcohol "Kuraray PVA 105" (trade name, produced by Kuraray Co., Ltd.) in a ball mill for a whole day to a volume average particle size of 3 μm.

80 g of calcined kaoline "Anisilex-93" (trade name, produced by Engelhard Corp.) were dispersed in 160 g of a 0.5% aqueous solution of sodium hexametaphosphate in a homogenizer.

5 g of the color former dispersion, 10 g of the color developer dispersion, 10 g of the heat-fusible substance dispersion, and 22 g of the calcined kaoline dispersion were mixed, and 4 g of a zinc stearate emulsion and 5 g of a 2% aqueous solution of sodium (2-ethylhexyl)sulfosuccinate were added thereto to prepare a coating composition.

The composition was coated on fine paper having a basis weight of 50 g/m$^2$ with a wire bar to a dry coverage of 6 g/m$^2$, followed by calendering to obtain a recording material.

EXAMPLE 16

A recording material was obtained in the same manner as in Example 15, except for replacing 4-chlorophenyl-4'-methoxybenzyl ether with 4-chlorophenyl-4'-ethoxybenzyl ether.

EXAMPLE 17

A recording material was obtained in the same manner as in Example 15, except for replacing 4-chlorophenyl-4'-methoxybenzyl ether with 4-methoxyphenyl-4'-chlorobenzyl ether.

EXAMPLE 18

A recording material was obtained in the same manner as in Example 15, except for replacing 4-chlorophenyl-4'-methoxybenzyl ether with 4-methylphenyl-4'-methoxybenzyl ether.

EXAMPLE 19

A recording material was obtained in the same manner as in Example 15, except for replacing 4-chlorophenyl-4'-methoxybenzyl ether with 3-methyl-4-chlorophenyl-4'-methoxybenzyl ether.

EXAMPLE 20

A recording material was obtained in the same manner as in Example 15, except for replacing 4-chlorophenyl-4'-methoxybenzyl ether with 3-methyl-4-chlorophenyl-4'-ethoxybenzyl ether.

EXAMPLE 21

A recording material was obtained in the same manner as in Example 15, except for replacing 4-chlorophenyl-4'-methoxybenzyl ether with 3,5-dimethyl-4-chlorophenyl-4'-ethoxybenzyl ether.

EXAMPLE 22

A recording material was obtained in the same manner as in Example 15, except for replacing 4-chlorophenyl-4'-methoxybenzyl ether with 5-methyl 2-chlorophenyl-4'-methoxybenzyl ether.

EXAMPLE 23

A recording material was obtained in the same manner as in Example 15, except for replacing 4-chlorophenyl4'-methoxybenzyl ether with 4-ethoxyphenyl-4'-chlorobenzyl ether.

EXAMPLE 24

A recording material was obtained in the same manner as in Example 15, except for replacing 4-chlorophenyl-4'-methoxybenzyl ether with 4-fluorophenyl-4'-ethoxybenzyl ether.

COMPARATIVE EXAMPLE 1

A recording material was obtained in the same manner as in Example 15, except for replacing 4-chlorophenyl-4'-methoxybenzyl ether with 4-chlorophenyl-4'-methylbenzyl ether.

COMPARATIVE EXAMPLE 2

A recording material was obtained in the same manner as in Example 15, except for replacing 4-chlorophenyl-4'-methoxybenzyl ether with 4-methylphenyl-4'-chlorobenzyl ether.

COMPARATIVE EXAMPLE 3

A recording material was obtained in the same manner as in Example 15, except for replacing 4-chlorophenyl-4'-methoxybenzyl ether with 2-benzyloxy-naphthalene.

In order to evaluate color developability of the recording materials of the present invention, heat sensitive recording was carried out on each of the recording materials obtained in Examples 15 to 24 and Comparative Examples 1 to 3 with a heat-sensitive printing test machine manufactured by Kyocera Co., Ltd. at a heat energy of 30 mJ/mm$^2$. The developed color densities were measured with Macbeth densitometer RD-918. The results obtained are shown below.

TABLE

| Example No. | Color Density |
|---|---|
| Example 15 | 1.35 |
| Example 16 | 1.30 |
| Example 17 | 1.33 |
| Example 18 | 1.35 |
| Example 19 | 1.35 |
| Example 20 | 1.30 |
| Example 21 | 1.30 |
| Example 22 | 1.33 |
| Example 23 | 1.35 |

TABLE-continued

| Example No. | Color Density |
|---|---|
| Example 24 | 1.30 |
| Comparative Example 1 | 1.15 |
| Example 2 | 1.10 |
| Example 3 | 1.10 |

As is apparent from the results shown above, the recording materials according to the present invention are superior in color developability.

EXAMPLE 25

Preparation of undercoated paper 80 g of calcined kaolin "Ansilex-90" (trade name, produced by Engelhard Corp.) were dispersed in 160 g of a 0.5% aqueous solution of sodium hexametaphosphate in a homogenizer.

To 60 g of the thus-obtained dispersion, 8 g of a 48% of styrene-butadiene latex (produced by Sumitomo Nogatac Co., Ltd.) was added to prepare a coating composition.

The coating composition was coated on a neutral paper having a basis weight of 50 g/m$^2$ as described in U.S. Pat. No. 4,255,491 with a wire bar to a dry coverage of 6 g/m$^2$, and then dried in an oven at 50° C. to obtain an undercoated paper.

Preparation of heat-sensitive coating solution 20 g each of 2-anilino-3-methyl-6-dibutylaminofluoran as a color former, bisphenol A as a color developer, and 4-ethoxyphenyl-4'-chlorobenzyl ether as a heat-fusible substance were separately dispersed in 100 g of a 5% aqueous solution of polyvinyl alcohol "Kuraray PVA-105" in a ball mill for a whole day to a volume average particle size of 3 μm or less.

80 g of calcium carbonate "Unibur 70" (trade name, produced by Shiraishi Kogyo Co. Ltd.) was dispersed in 160 g of a 0.5% aqueous solution of sodium hexametaphosphate by means of a homogenizer.

5 g of the color former dispersion, 10 g of the color developer dispersion, 10 g of the heat-fusible substance dispersion, and 15 g of the calcium carbonate dispersion were mixed, and 3 g of 21% zinc stearate emulsion were added thereto to prepare a coating composition.

The coating composition was coated on the above-obtained undercoated paper with a wire bar to a dry coverage of 6 g/m$^2$, and then dried in an oven at 50° C. to obtain a recording material.

In order to evaluate color developability, the thus-obtained recording material was color developed in the same manner as in Example 15. The developed color density of 1.34 was obtained.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having provided thereon an electron donating colorless dye, an electron accepting compound, and a benzyl ether derivative represented by formula (I):

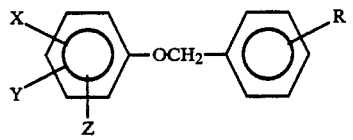

(I)

wherein R represents a halogen atom or a substituted or unsubstituted alkoxy group; and when R is a substituted or unsubstituted alkoxy group, X, Y and Z, which may be the same or different, each represents a hydrogen atom, a substituted or unsubstituted alkyl group, a substituted or unsubstituted alkoxy group or a halogen atom; and when R is a halogen atom, X represents a substituted or unsubstituted alkoxy group, and Y and Z each represents a hydrogen atom.

2. The recording material as claimed in claim 1, wherein at least one of R, X, Y, and Z is an alkoxy group, and at least one of the other group is a halogen atom.

3. The recording material as claimed in claim 1, wherein the alkoxy group contains from 1 to 4 carbon atoms.

4. The recording material as claimed in claim 1, wherein the benzyl ether derivative is represented by the formula (II):

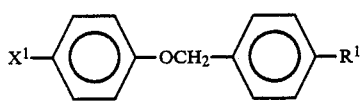

(II)

wherein $X^1$ represents an alkoxy group, and $R^1$ represents a halogen atom.

5. The recording material as claimed in claim 1, wherein the benzyl ether derivative is represented by the formula (III):

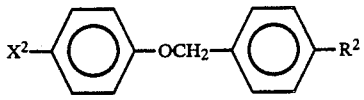

(III)

wherein $X^2$ represents an alkyl group or an alkoxy group, and $R_2$ represents an alkoxy group.

6. The recording material as claimed in claim 1, wherein the benzyl ether derivative is represented by the formula (IV):

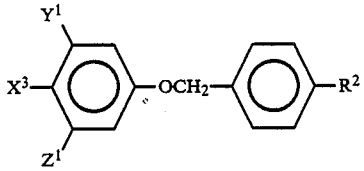

(IV)

wherein $X^3$ represents a halogen atom, $Y^1$ and $Z^1$ represents a hydrogen atom or an alkyl group, and $R^2$ represents an alkoxy group.

7. The recording material as claimed in claim 1, wherein said benzyl ether derivative is present in an amount of from 50 to 200% by weight based on the electron accepting compound.

8. The recording material as claimed in claim 1, wherein said benzyl ether derivative is 4-ethoxyphenyl-4'-chlorobenzyl ether.

9. The recording material as claimed in claim 1, wherein said benzyl ether derivative is 3-methyl-4-chlorophenyl-4'-methoxybenzyl ether.

10. The recording material as claimed in claim 1, wherein said benzyl ether derivative is 4-chlorophenyl-4'-methoxybenzyl ether.

11. The recording material as claimed in claim 1, wherein said benzyl ether derivative is 4-methylphenyl-4'-methoxybenzyl ether.

12. The recording material as claimed in claim 1, wherein said benzyl ether derivative is 3,5-dimethyl-4-chlorophenyl-4'-methoxybenzyl ether.

13. The recording material as claimed in claim 1, wherein said benzyl ether derivative is 4-fluorophenyl-4'-ethoxybenzyl ether.

14. The recording material as claimed in claim 1, wherein said benzyl ether derivative is 4-methoxyphenyl-4'-chlorobenzyl ether.

* * * * *